US006318236B1

(12) United States Patent
Miyazawa et al.

(10) Patent No.: US 6,318,236 B1
(45) Date of Patent: Nov. 20, 2001

(54) RECIPROCAL MOTION TYPE COMPRESSOR HAVING A PISTON IN WHICH STRENGTH IS INCREASED

(75) Inventors: Kiyoshi Miyazawa, Annaka; Yujiro Morita, Honjo, both of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/291,303

(22) Filed: Apr. 15, 1999

(30) Foreign Application Priority Data

Apr. 15, 1998 (JP) ..... 10-104799

(51) Int. Cl.[7] ..... F01B 13/04

(52) U.S. Cl. ..... 92/12.2; 92/57; 92/71; 92/255; 92/260; 417/269

(58) Field of Search ..... 92/12.2, 71, 172, 92/57, 255, 260; 417/269

(56) References Cited

U.S. PATENT DOCUMENTS 2,246,942 * 6/1941 Janney et al. ..... 92/260
5,174,728 * 12/1992 Kimura et al. ..... 92/71 X
5,265,331 * 11/1993 Engel et al. ..... 92/260 X
5,630,353 5/1997 Mittlefehldt et al. .
5,765,464 6/1998 Morita .

FOREIGN PATENT DOCUMENTS 10-159725 6/1998 (JP) .

* cited by examiner

*Primary Examiner*—Hoang Nguyen
(74) *Attorney, Agent, or Firm*—Baker Botts L.L.P.

(57) ABSTRACT

There is provided a reciprocal motion type compressor which has a piston reciprocally movable in a cylinder. The piston has a piston cover and a piston body portion. The piston cover has an insertion portion engaged with the piston body portion. The insertion portion has a sectional shape which becomes smaller gradually from the cover portion toward an end surface of the insertion portion. This structure provides an increased tensile strength of the piston.

9 Claims, 3 Drawing Sheets

RECIPROCAL MOTION TYPE COMPRESSOR HAVING A PISTON IN WHICH STRENGTH IS INCREASED

BACKGROUND OF THE INVENTION

The present invention relates in general to a compressor and more particularly to a reciprocal motion type compressor generally and widely used for automotive vehicles, cars and the like.

A conventional reciprocal motion type compressor comprises a cylinder block defining a cylinder bore extending in an axial direction of the compressor. A piston is placed in the cylinder bore to be movable in the axial direction. The piston is reciprocally driven in the axial direction through a driving mechanism by an engine mounted on, for example, an automobile.

In the conventional reciprocal motion type compressor, the piston comprises a body member and a cover member coupled to the body member. The body member has a hollow portion at a rear portion thereof. The cover member has an insertion portion inserted into the hollow portion of the body member. After the insertion portion is inserted into the hollow portion, the body member and the cover member are fixed together by, for example, an electronic beam welding technique to form a coupling portion.

In the piston, there is a serious problem in mechanical strength in the coupling portion between the body member and the cover member in the axial direction. That is, the strength in the coupling portion is rather weak in the conventional structure. Therefore, the coupling portion has less durability relative to a repeated reciprocal movement of the compressor, particularly in a high speed operation of the compressor.

SUMMARY OF THE INVENTION

It is therefore an object of the present invention to provide a new and improved compressor, particularly in a swash plate type compressor, which has an improved, increased tensile strength in a piston structure in an axial direction.

Other objects of the present invention will become clear as the description proceeds.

According to an aspect of the present invention, there is provided a reciprocal motion type compressor which comprises a cylinder block defining a cylinder bore extending in an axial direction of the compressor, a piston placed in the cylinder bore and movable in the axial direction, and driving means for reciprocally driving the piston in the axial direction. The piston comprises a body member having a front portion and a rear portion which are opposite to each other in the axial direction. The front portion is coupled to the driving means. The rear portion has a rear surface and a hollow portion extending from the rear surface in the axial direction. The piston further comprises a cover member coupled to the rear portion of the body member to close the hollow portion. The cover member comprises a plate portion fixed to the rear surface of the body member in the axial direction and a flange formed integral with the plate portion and inserted into the hollow portion of the body member for reinforcing the plate portion.

According to another aspect of the present invention, there is provided a reciprocal motion type compressor comprising a piston reciprocally movable in a cylinder bore. In the compressor, the piston has a cover member and a body member fixed to each other. The cover member has an insertion portion engaged with a rear section of the body member. The insertion portion has a sectional area becoming smaller gradually from a rear end of the insertion portion towards a front end thereof.

According to still another aspect of the present invention, there is provided a reciprocal motion type compressor which comprises a cylinder block defining a cylinder bore extending in an axial direction of the compressor, a piston placed in the cylinder bore and movable in the axial direction, and driving means for reciprocally driving the piston in the axial direction. The piston comprises a body member having a front portion and a rear portion which are opposite to each other in the axial direction. The front portion is coupled to the driving means. The rear portion has a rear surface and a hollow portion extending from the rear surface in the axial direction. The piston further comprises a cover member coupled to the rear portion of the body member and comprising a fitting portion substantially closely fitted into the hollow portion of the body member. The fitting portion comprises a front section having a first sectional area and a rear section having a second sectional area which is greater than the first sectional area.

DESCRIPTION OF THE PREFERRED EMBODIMENTS

Figure 1:
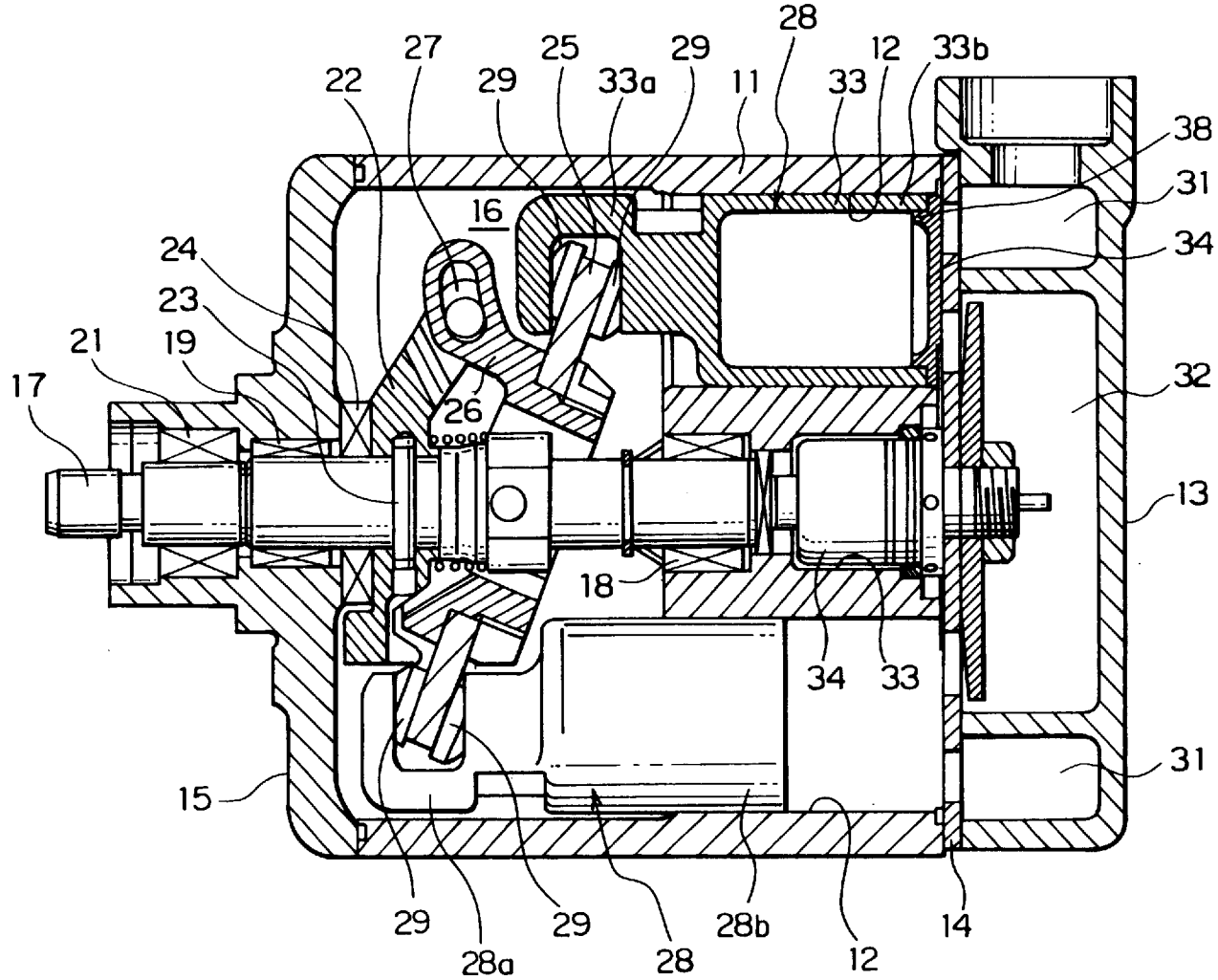
FIG. 1 is a longitudinal sectional view of a reciprocal motion type compressor according to an embodiment of the present invention.

Referring to FIG. 1, description will be made as regards a reciprocal motion type compressor according to an embodiment of the present invention.

The compressor is a volume variable compressor of a swash plate type known in the art and comprises a cylinder block 11 having a plurality of cylinder bores 12 each extending in an axial direction of the compressor, a cylinder head 13 fixed to an end of the cylinder block 11 in the axial direction through a valve plate 14, and a front housing 15 fixed to the other end of the cylinder block 11 in the axial direction. The cylinder block 11 and the front housing 15 defines a crank chamber 16 in cooperation with each other.

A drive shaft 17 is rotatably supported by the cylinder block 11 and the front housing 15 via a rear radial bearing 18 and two front radial bearings 19 and 21. The drive shaft 17 is driven by, for example, an engine of an automobile. A rotor 22 is placed in the crank chamber 16 and fixed to the drive shaft 17 by a pin member 23. A thrust bearing 24 is interposed between the rotor 22 and the front housing 15. A swash plate 25 is placed in the crank chamber 16 and coupled to the rotor 22 through a plate boss 26 and a hinge mechanism 27. The hinge mechanism 27 makes the swash plate 25 have an angle which is variable in the manner known in the art. It is a matter of course that the swash plate 25 is rotated together with the drive shaft 17 and the rotor 22.

A plurality of pistons 28 are slidably inserted in the cylinder bores 12, respectively. Each of the pistons 28 is engaged with a peripheral portion of the swash plate 25 via shoes 29 in the axial direction. In accordance with the rotation of the swash plate 25, a plurality of pistons 28 are driven via the shoes 29 in the cylinder bores 12, respectively. As a result, each of the pistons 28 is reciprocated to cause compression of a gaseous fluid such as a refrigerant gas. In other words, the gaseous fluid is displaced from a suction chamber 31 to a discharge chamber 32 through the cylinder bores 12 in response to reciprocation of each of the pistons 28. A combination of the drive shaft 17, the rotor 22, the hinge mechanism 27, the plate boss 26, the swash plate 25, and the shoes 29 is referred to as a driving arrangement.

The cylinder block 11 has a center bore 33 penetrating in the predetermined direction at a central portion thereof. A flow control valve 34 is placed in a rear portion of the center bore 33 and is for controlling a flow of the gaseous fluid between the crank chamber 16 and the suction chamber 31 in the manner known in the art.

Figure 2:
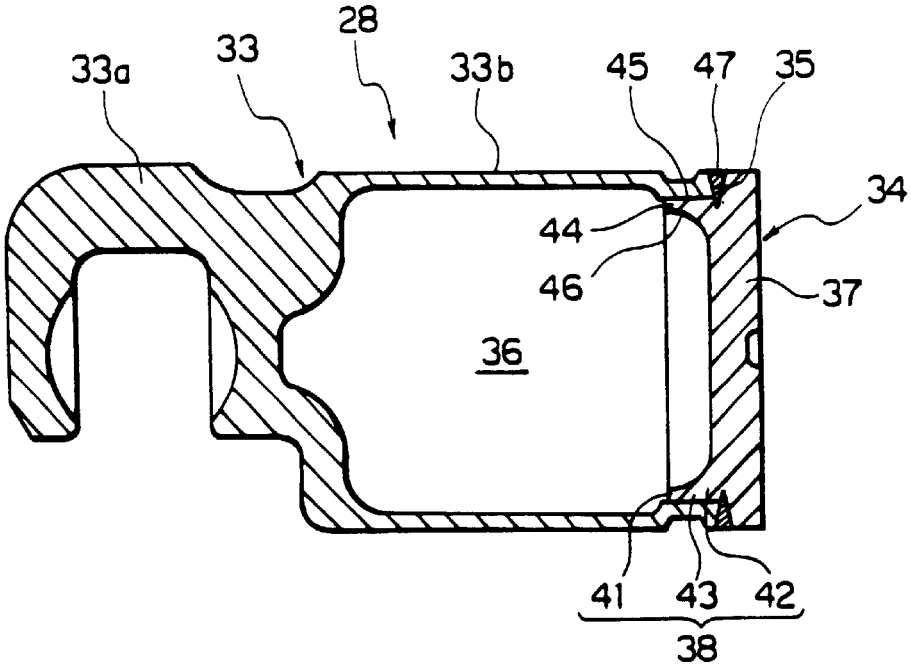
FIG. 2 is an enlarged sectional view of a piston included in the compressor of FIG. 1.

Referring to FIG. 2 in addition, the description will be directed to the piston 28.

In the compressor, the piston 28 comprises a body member 33 and a cover member 34 coupled to the body member 33. The body member 33 has a front portion 33*a* and a rear portion 33*b* which are opposite to each other in the axial direction. The front portion 33*a* is coupled to swash plate 25 via the shoes 29. The rear portion 33*b* has a rear surface 35 and a hollow portion 36 extending from the rear surface 35 in the axial direction.

The cover member 34 comprises a plate portion 37 and an insertion portion or a fitting portion 38 which is formed integral with the plate portion 37 and protrudes from the plate portion 37 in the axial direction. The fitting portion 38 is substantially closely fitted into the hollow portion 36 of the body member 33. The plate portion 37 is fixed to the rear surface 35 of the body member 33 in the axial direction by welding and others.

The fitting portion 38 comprises a front end or a front section 41 having a first sectional area, a rear end or a rear section 42 having a second sectional area greater than the first sectional area, and an intermediate section 43 between the front and the rear sections 41 and 42. The intermediate section 43 has a sectional area becoming smaller gradually from the rear section 42 towards the front section 41.

In other words, the fitting portion 38 has a circular flange 44 for reinforcing the plate portion 37. With the circular flange 44, deformation of the plate portion 37 is suppressed even when tensile force acts to the plate portion 37 on the compressor being driven. Therefore, tensile stress does not concentrate at a local area or portion between the rear surface 35 of the body member 33 and the plate portion 37. This results in an increase of tensile strength of the cover member 34.

The circular flange 44 is defined between an outer peripheral surface 45 and an inner peripheral surface 46 which is opposite to the outer peripheral surface 45 in a radial direction perpendicular to the axial direction. The outer peripheral surface 45 has a size substantially even between the front and the rear sections 41 and 42. The inner peripheral surface 46 becomes greater gradually from the rear section 42 towards the front section 41 to form a smoothly curved concave known in the art.

The body member 33 and the cover member 34 are fixed together by, for example, an electronic beam welding technique to form a coupling portion having a welded portion 47. In place of a welding method, use may be made of a mechanical method or a chemical method for fixing the body member 33 and the cover member 34 to each other. More particularly, other connecting technique can be used such as a mechanical coupling technique by using a threaded engagement and a chemical coupling by using desired adhesives. A tensile strength of the coupled elements exhibits substantially the same properties.

In the compressor, each of the pistons 28 is has a hollow structure to avoid an increase of an inertia force to thereby avoid difficulties for a high speed operation. On the other hand, if each piston 28 is solid, an inertia force is increased to prevent desirable high speed operation. It is preferable that each piston 28 is made of aluminum for the purpose of weight saving.

In each piston 28, a great amount of load is added to the cover member 34 which forms a "head" portion of the piston. The load added to the cover member 34 is consequently concentrated on the above-mentioned coupling portion. However, the coupling portion is prevented from a breakdown thereof because the coupling portion has increased tensile strength in the axial direction.

Figure 3:
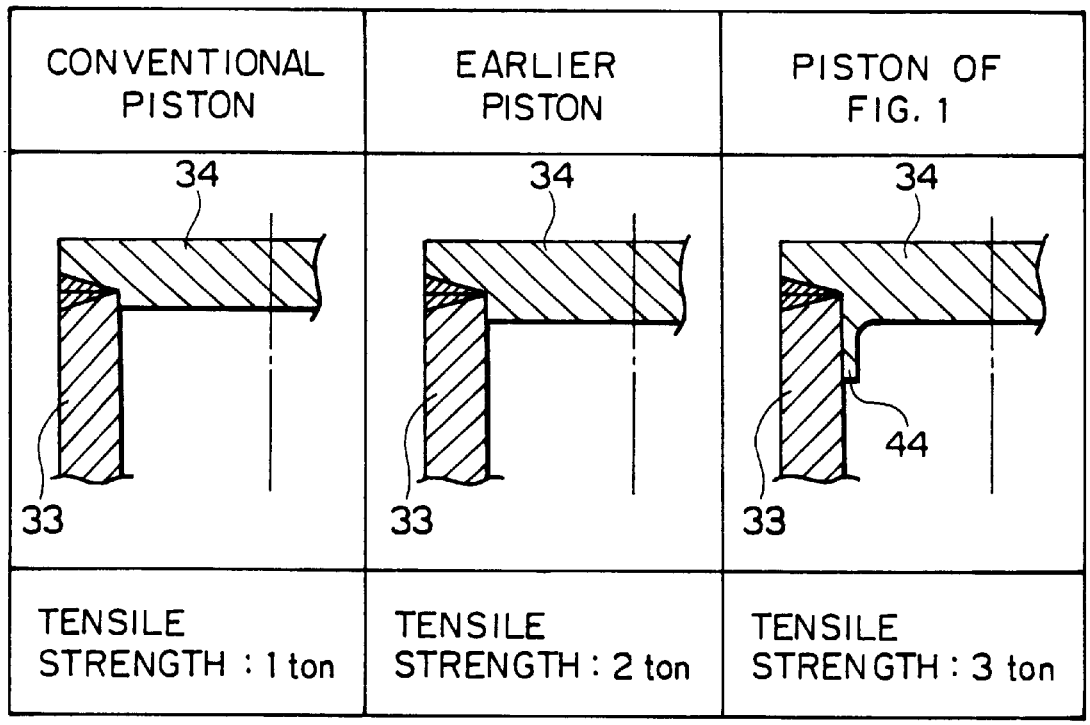
FIG. 3 is a diagram showing a comparison in a tensile strength among the piston of FIG. 2, a conventional piston, and an earlier piston.

Referring to FIG. 3, the description will be proceeded. Experiments have proved that the products (pistons) of the present invention had a larger mechanical strength than each of the conventional piston and the earlier piston. The conventional piston had a tensile strength of only 1 ton (1,000 kg). The earlier piston modified in a thickness of the cover member 34 was twice as large as the conventional product and had a tensile strength of 2 tons (2,000 kg). By contrast, the piston of FIG. 1 with the same thickness of the cover member 34 had a much larger tensile strength of 3 tons (3,000 kg).

In the piston 28 of FIG. 2, the fitting portion 38 is so formed that its cross sectional shape is gradually decreased and it was found by the experiments that this structure of the fitting portion 38 can provide a remarkable advantage without an increase of an entire thickness of the piston. It will be conceived that the advantage described above is induced by the structural feature of the fitting portion 38, which is formed gradually decreased in its cross sectional shape as described above, because it is supposed that the fitting portion 38 is extended and closely contacted with the body member 33 against shocks or any other external forces and consequently provides a strong adhesive force and an absorption force relative to the body member 33.

Figure 4:
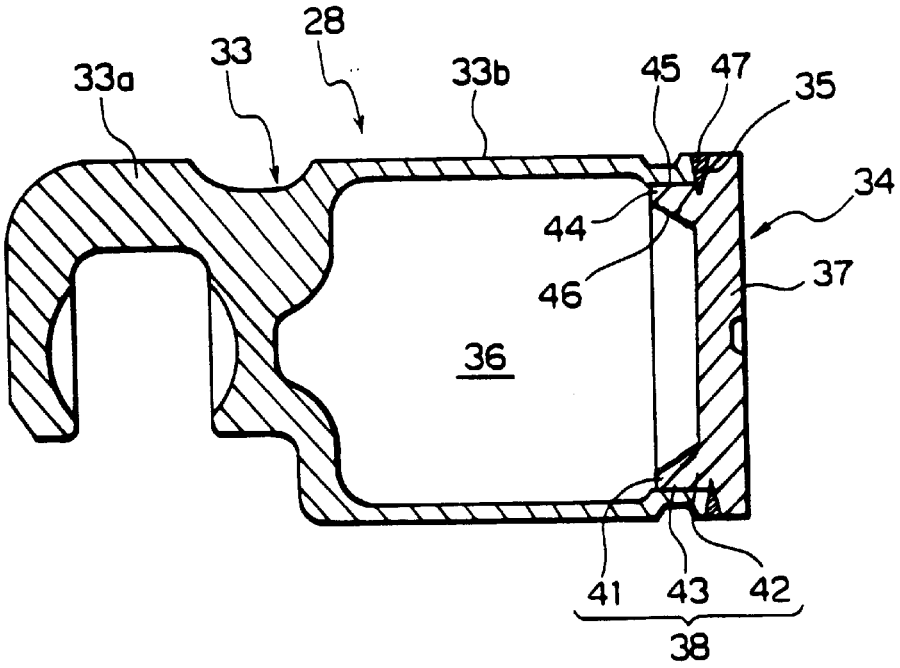
FIG. 4 is an enlarged sectional view of another piston which can be included in the compressor of FIG. 1.

Referring to FIG. 4, the description will be made as regards a modification of the piston 28. In the modification, the outer peripheral surface 45 has a size substantially even between the front and the rear sections 41 and 42. The inner peripheral surface 46 becomes greater gradually from the rear section 42 towards the front section 41 to form a conical surface known in the art.

According to the above-mentioned compressors, there is provided an improved structure of the piston for a compressor which permits a simple structure and provides a large mechanical strength against tensile and compressive forces and, in addition, suitably applicable to an high speed operation and various types of compressors, for example, those employing reciprocal pistons. In a case of a reciprocal motion type compressor, a great advantage can be expected in operational properties.

While the present invention has thus far been described in connection with a few embodiments thereof, it will readily be possible for those skilled in the art to put this invention into practice in various other manners. For example, other cross sectional shapes can be applied such as various curves, straight lines and combinations thereof in the inner peripheral surface. Although the description is made as regards the volume variable, swash plate type compressor, the present invention is not limited to this type of compressor but can be extensively applied to the other types of compressor employing reciprocally movable pistons and, in that case, the invention can be applied to members and elements which receive compressive force and tensile force. Particularly, the present invention can be remarkably applied to the case of a high speed operation. In addition, the invention will be applicable to the other various parts and elements which are expected to provide similar actuation and operation.

What is claimed is:

1. A reciprocal motion type compressor comprising a cylinder block defining a cylinder bore extending in an axial direction of the compressor, a piston placed in said cylinder bore and movable in said axial direction, and driving means for reciprocally driving said piston in said axial direction, said piston comprising:

a body member having a front portion and a rear portion which are opposite to each other in said axial direction, said front portion being coupled to said driving means, said rear portion having a rear surface and a hollow portion extending from said rear surface in said axial direction; and a cover member coupled to said rear portion of said body member to close said hollow portion, said cover member comprising a solid plate portion fixed to said rear surface of said body member in said axial direction and a flange formed integral with said plate portion and inserted into said hollow portion of said body member for reinforcing said plate portion.

2. A reciprocal motion type compressor as claimed in claim 1, wherein said flange comprises:

a front section having a first sectional area;

a rear section having a second sectional area which is greater than said first sectional area; and an intermediate section between said front and said rear sections, said intermediate section having a sectional area which becomes smaller gradually from said rear section towards said front section.

3. A reciprocal motion type compressor as claimed in claim 2, wherein said flange is of a circular shape and substantially closely fitted into said hollow portion of said body member.

4. A reciprocal motion type compressor as claimed in claim 3, wherein said flange has an outer and an inner peripheral surface which are opposite to each other in a radial direction perpendicular to said axial direction, said outer peripheral surface having a size substantially even between said front and said rear sections.

5. A reciprocal motion type compressor as claimed in claim 4, wherein said inner peripheral surface becomes greater gradually from said rear section towards said front section to form a smoothly curved concave surface.

6. A reciprocal motion type compressor as claimed in claim 4, wherein said inner peripheral surface becomes greater gradually from said rear section towards said front section to form a conical surface.

7. A reciprocal motion type compressor as claimed in claim 1, wherein said cover member is fixed to said body member by at least one method selected from the group consisting of a welding method, a mechanical method, and a chemical method.

8. A reciprocal motion type compressor comprising a piston reciprocally movable in a cylinder bore, wherein said piston has a solid cover member and a body member fixed to each other, said body member having a rear surface and a hollow portion extending from said rear surface in an axial direction, said cover member having an insertion portion engaged with a rear section of said body member, said insertion portion being substantially closely fitted into said hollow portion so as to close said hollow portion, said insertion portion having a sectional area becoming smaller gradually from a rear end of said insertion portion towards a front end thereof.

9. A reciprocal motion type compressor comprising a cylinder block defining a cylinder bore extending in an axial direction of the compressor, a piston placed in said cylinder bore and movable in said axial direction, and driving means for reciprocally driving said piston in said axial direction, said piston comprising:

a body member having a front portion and a rear portion which are opposite to each other in said axial direction, said front portion being coupled to said driving means, said rear portion having a rear surface and a hollow portion extending from said rear surface in said axial direction; and a solid cover member coupled to said rear portion of said body member and comprising a fitting portion substantially closely fitted into said hollow portion of said body member to close said hollow portion, said fitting portion comprising a front section having a first sectional area and a rear section having a second sectional area which is greater than said first sectional area.

* * * * *